US005492086A

United States Patent [19]

Kuhns

[11] Patent Number: 5,492,086

[45] Date of Patent: Feb. 20, 1996

[54] VALVE COVER

[75] Inventor: Jack M. Kuhns, Strongsville, Ohio

[73] Assignee: Durox Company, Inc., Strongsville, Ohio

[21] Appl. No.: 306,676

[22] Filed: Sep. 15, 1994

[51] Int. Cl.[6] ..... F01M 9/10

[52] U.S. Cl. ..... 123/90.38; 123/198 E; 123/195 C; 184/6.5; 184/11.1

[58] Field of Search ..... 123/90.33, 90.34, 123/90.37, 90.38, 195 C, 198 E; 184/6.5, 11.1, 13.1, 106

[56] References Cited

U.S. PATENT DOCUMENTS

| | | | |
|---|---|---|---|
| 1,403,540 | 1/1922 | Church | 123/90.27 |
| 1,415,067 | 5/1922 | Vincent | 384/404 |
| 2,710,603 | 12/1952 | Sheppard | 123/90.38 |
| 3,875,908 | 4/1975 | Ayres | 123/90.36 |
| 4,124,011 | 11/1978 | Saito et al. | 123/195 C |
| 4,471,731 | 9/1984 | Kasting et al. | 123/90.38 |
| 5,228,420 | 7/1993 | Furuya et al. | 123/90.38 |
| 5,323,740 | 6/1994 | Daily et al. | 123/90.38 |

*Primary Examiner*—Weilun Lo
*Attorney, Agent, or Firm*—Tarolli, Sundheim & Covell

[57] ABSTRACT

A cover (10) is for use on a multi-cylinder overhead camshaft engine (20) having a pair of projecting members (112, 120). The cover (10) has a plurality of walls (300–308) for intercepting oil sprayed from the camshaft (80) of the engine. A pair of tubular projections (328, 330) connected with one wall (300) of the cover are engageable in a press fit relationship with the projecting members to support the cover in a position adjacent to the camshaft. A plurality of ribs (310–324) are disposed generally above the camshaft and extend parallel to the camshaft for catching and collecting oil sprayed from the camshaft and for dripping the oil down onto the camshaft. A W-shaped rib (326) on the inside of the cover collects oil flowing along the inside of the cover. The oil drips down from points (476, 486) of the W-shaped rib to lubricate selected portions (180, 206) of the engine. A multi-cylinder cover assembly (42, 60) encloses a plurality of the covers (10). A respective cover (10) is associated with each respective cylinder assembly (30) of the engine (20). The walls of the cover (10) block flow of oil onto the joints of the multi-cylinder cover assembly (42, 60) to minimize leakage.

50 Claims, 8 Drawing Sheets

VALVE COVER

BACKGROUND OF THE INVENTION

1. Technical Field

The present invention relates to a cover for an internal combustion engine. In particular, the present invention relates to a cover for controlling the flow of lubricating oil in an overhead camshaft engine.

2. Description of the Prior Art

One known type of internal combustion engine is an overhead camshaft two-stroke cycle diesel engine which is commonly used in diesel-electric locomotives and in marine and power generation applications. This engine has been produced by Electro-Motive Division of General Motors Corporation (EMD) and has a vee configuration with two parallel banks of cylinder assemblies. On each side of the vee is an overhead camshaft which is driven for rotation. As the camshaft rotates, cam lobes on the camshaft engage followers on rocker arms to actuate overhead valve mechanism and fuel injectors for that bank of cylinder assemblies.

Each camshaft is supplied with lubricating oil through internal passages. The lubricating oil is channeled to the cam lobes of the camshaft to lubricate the cam lobes and the followers. As each camshaft rotates, a portion of the lubricating oil on the camshaft sprays from the rotating cam lobes and also sprays from other moving parts of the engine including the rocker arms and the followers.

A portion of the sprayed oil lands on other engine parts to lubricate and cool them. Improved lubrication of those engine parts can help avoid premature wear and damage of the parts, resulting in a reduction in expensive maintenance and downtime.

Other portions of the sprayed oil contact a cylinder head cover of the engine and its support frame. The cylinder head cover and its support frame enclose the camshaft, the overhead valve mechanism of the cylinder assemblies, and components of the fuel injection system. The oil which contacts the cylinder head cover and its support frame collects and drains down along them onto the top deck of the engine, from where it is conducted to the engine oil sump.

The oil which is sprayed as a result of the rotating action of the camshaft can leak out of the enclosure formed by the cylinder head cover and support frame. This is because the cylinder head cover and its support frame are long, somewhat flexible pieces which during operation of the engine do not stay tightly sealed against the engine and against each other even though gaskets are used. Oil leakage has numerous potentially undesirable results such as air pollution, fires, or environmental damage. Leakage of oil also results in the use of more oil than otherwise necessary for the engine. Excess oil leakage can result in a costly shutdown of the engine.

SUMMARY OF THE INVENTION

The present invention is a cover for use on a multi-cylinder internal combustion engine having a rotatable overhead camshaft and having associated with each respective cylinder (i) an overhead control mechanism for operating one or more engine parts in response to rotation of the camshaft and (ii) a pair of projecting members disposed adjacent to the control mechanism of the cylinder with which the members are associated. The camshaft is supplied with lubricating oil a portion of which sprays from the camshaft when the camshaft rotates. The cover is for use in association with a respective one of the cylinders. The cover includes a wall for intercepting oil sprayed from the cam, and a pair of tubular projections connected with the wall and engageable in a press fit relationship with the projecting members for supporting the wall in a position adjacent to the camshaft.

In a preferred embodiment, the cover includes a plurality of walls for intercepting oil sprayed as a result of rotating action of the camshaft. At least some of the walls have lower end portions which are spaced from the engine and which do not seal against the engine. A plurality of ribs are formed on one wall at a location generally above the camshaft and extending parallel to the camshaft. The ribs collect oil sprayed from the camshaft and drip some of the collected oil down onto the camshaft. A W-shaped rib on the inside of the cover collects oil flowing along the inside of the cover. The oil drips down from points of the W-shaped rib onto selected portions of the operating mechanism of the cylinder with which the cover is associated. A multi-cylinder cover assembly encloses a plurality of covers including the one cover, at least a portion of the camshaft, and a plurality of adjacent operating mechanisms. Each one of the plurality of covers is used in association with a respective one of the plurality of adjacent operating mechanisms. The walls of the covers block flow of oil onto the joints of the multi-cylinder cover assembly.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
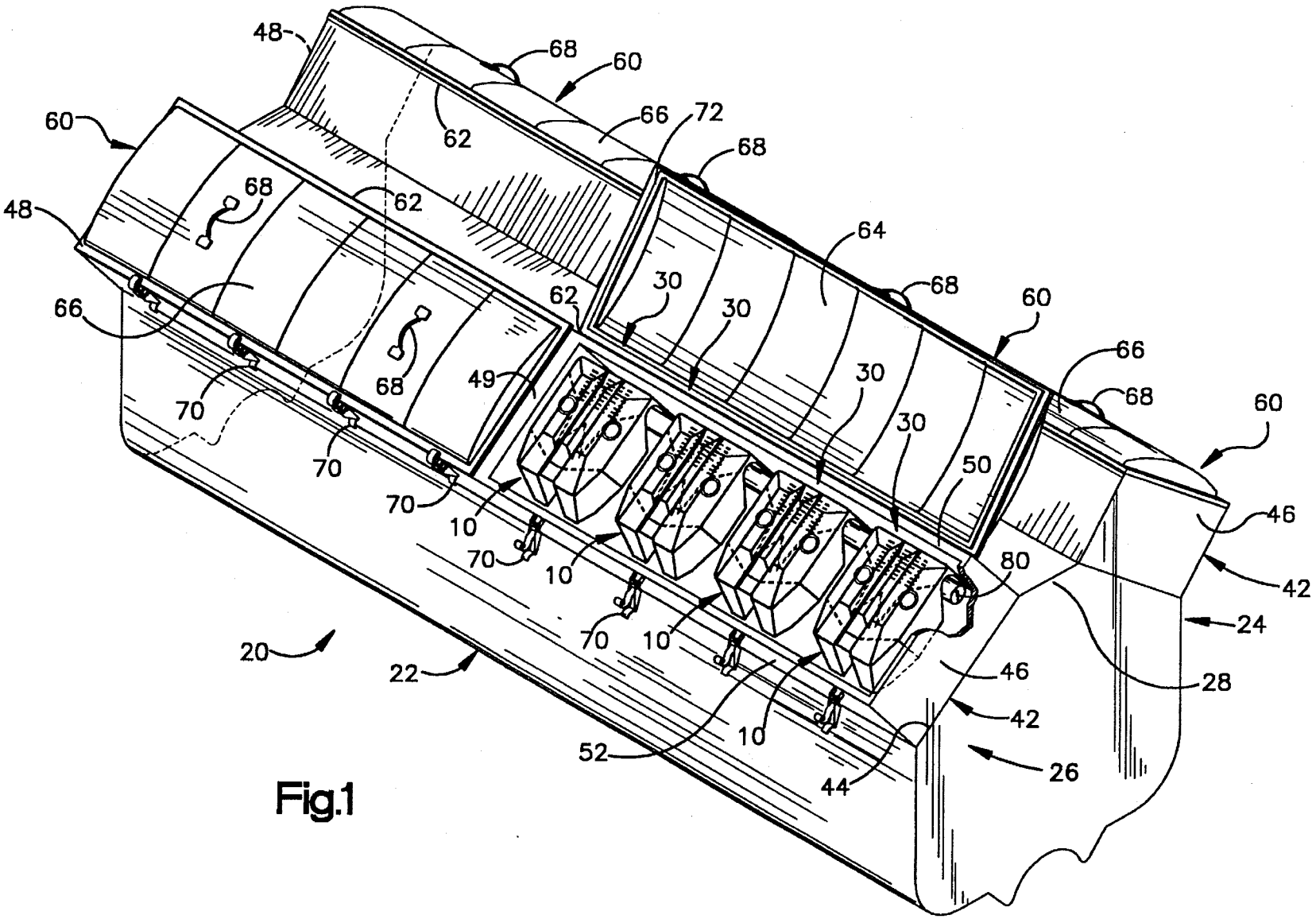
FIG. 1 is a simplified perspective view of a portion of an engine having a plurality of cylinder assemblies and a plurality of covers in accordance with the present invention associated one with each cylinder assembly.

The present invention relates to a cover for an internal combustion engine and particularly to a cover for controlling the flow of lubricating oil in an overhead camshaft engine. The present invention is applicable to various cover constructions. As representative of the present invention, FIG. 1 illustrates a plurality of identical covers 10.

The covers 10, which are described below in detail, are mounted on an engine 20. The engine 20 includes a crankcase which is designated generally 22. The crankcase defines two cylinder banks 24 and 26 which form between them a 45° vee 28. In the illustrated engine 20, which is a sixteen cylinder engine, each cylinder bank 24 and 26 includes eight identical cylinder assemblies 30. One cover 10 is associated with each cylinder assembly 30.

Extending over each cylinder bank 24 and 26 is a cylinder head cover support frame 42 which is supported on a top deck portion 44 (FIG. 8) of the crankcase 22. Each cylinder head cover support frame 42 is generally rectangular in configuration and includes parallel spaced end walls 46 and 48 and a central cross-member 49. The end walls 46 and 48 are interconnected by parallel inner and outer side walls 50 and 52. (As used in the description herein, the term "inner" means closer to the vee 28 of the engine—that is, to the right as viewed in FIGS. 2, 3 and 8. The term "outer" means farther from the vee 28 of the engine—that is, to the left as viewed in FIG. 2, 3 and 8.) The inner side wall 50 (FIG. 8) of the support frame 42 has a planar lower surface 54 separated by a gasket 55 from a planar upper side surface 56 of the crankcase top deck 44. The outer side wall 52 of the support frame 42 has a planar lower surface 57 separated by a gasket 58 from the upper side surface 56 of the crankcase top deck 44.

Each cylinder head cover support frame 42 supports a pair of identical cylinder head covers 60. Each cylinder head cover 60 extends over and covers four cylinder assemblies 30. Each cylinder cover 60 is connected by a hinge indicated schematically at 62 with the inner wall 50 of the cylinder head cover support frame 42. Each cylinder head cover 60 has an inner major side surface 64 and an outer major side surface 66 from which project a pair of handles 68. A plurality of hold-downs 70 on the outer wall 52 of each cylinder head cover support frame 42 secure the cylinder head covers 60 in a closed position. A gasket 72 extends around the outer periphery of each cylinder head cover 60 and seals between the cylinder head cover and the upper edge portions of the four walls 46–52 of the cylinder head cover support frame 42.

It should be understood that the present invention is applicable to internal combustion engines having different numbers or configurations of cylinders. For example, the illustrated engine is an EMD-type engine. As used herein, the term "EMD-type engine" means an engine designed, produced, or sold by Electro-Motive Division of General Motors Corporation or its predecessors. Known EMD-type engines have 6, 8, 12, 16, or 20 cylinders. A six-cylinder EMD-type engine has two banks of three cylinders each, with one cylinder head cover 60 per bank. An eight-cylinder EMD-type engine has two banks of four cylinders each, with one cylinder head cover 60 per group of four cylinders, that is, one cylinder head cover per bank. A twelve-cylinder EMD-type engine has two banks of six cylinders each, with one cylinder head cover 60 per group of three cylinders, or two cylinder head covers per bank. A twenty-cylinder EMD-type engine has two banks of ten cylinders each, with one cylinder head cover 60 per group of five cylinders, or two cylinder head covers per bank. It should also be understood that the present invention is useful in association with other brands and types of engines.

Figure 2:
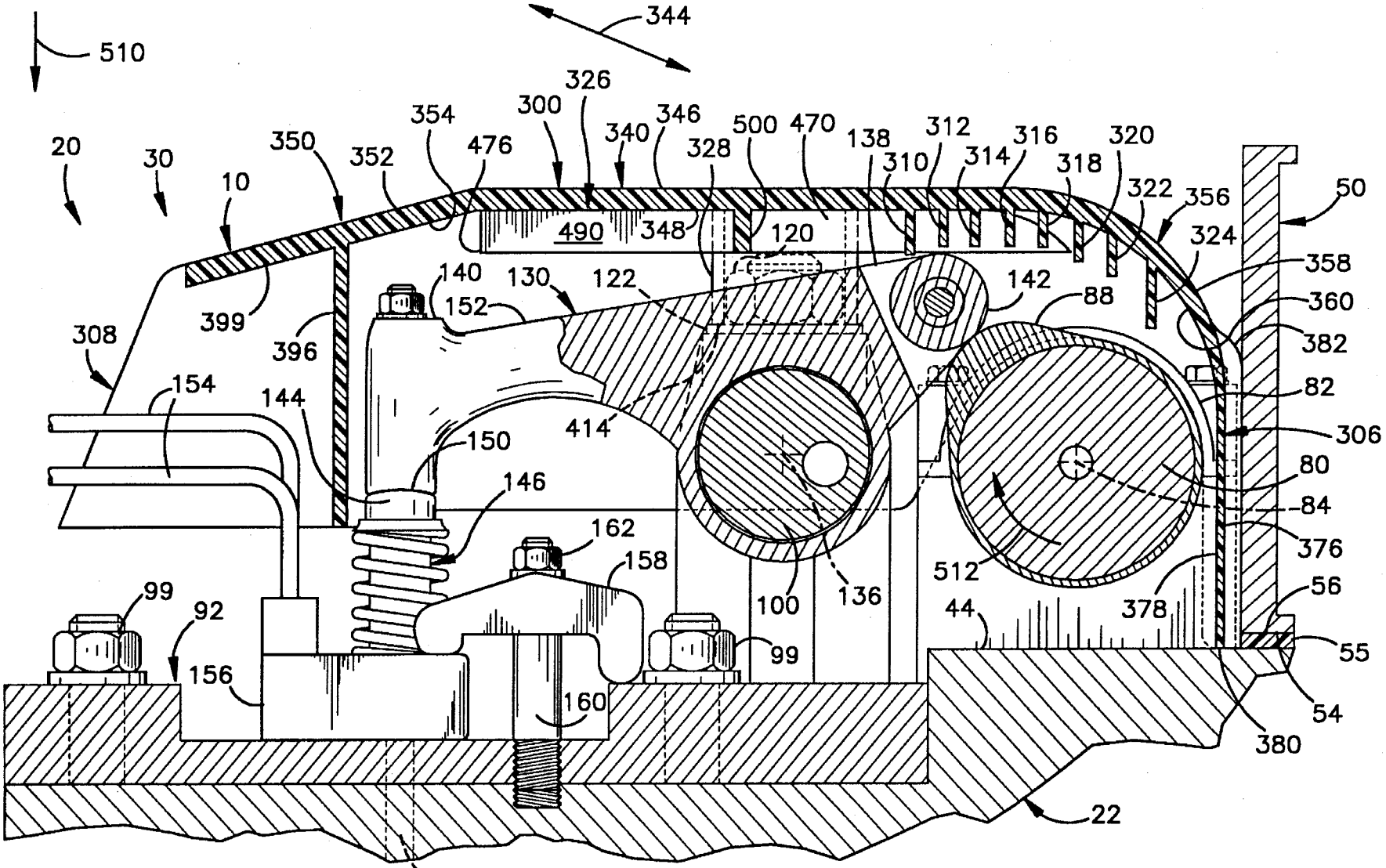
FIG. 2 is a view partially in section and with parts removed through a portion of the engine of FIG. 1 showing the relationship between one of the covers and a fuel injector actuator mechanism of the associated cylinder assembly, taken generally along line 2—2 of FIG. 4.
Figure 3:
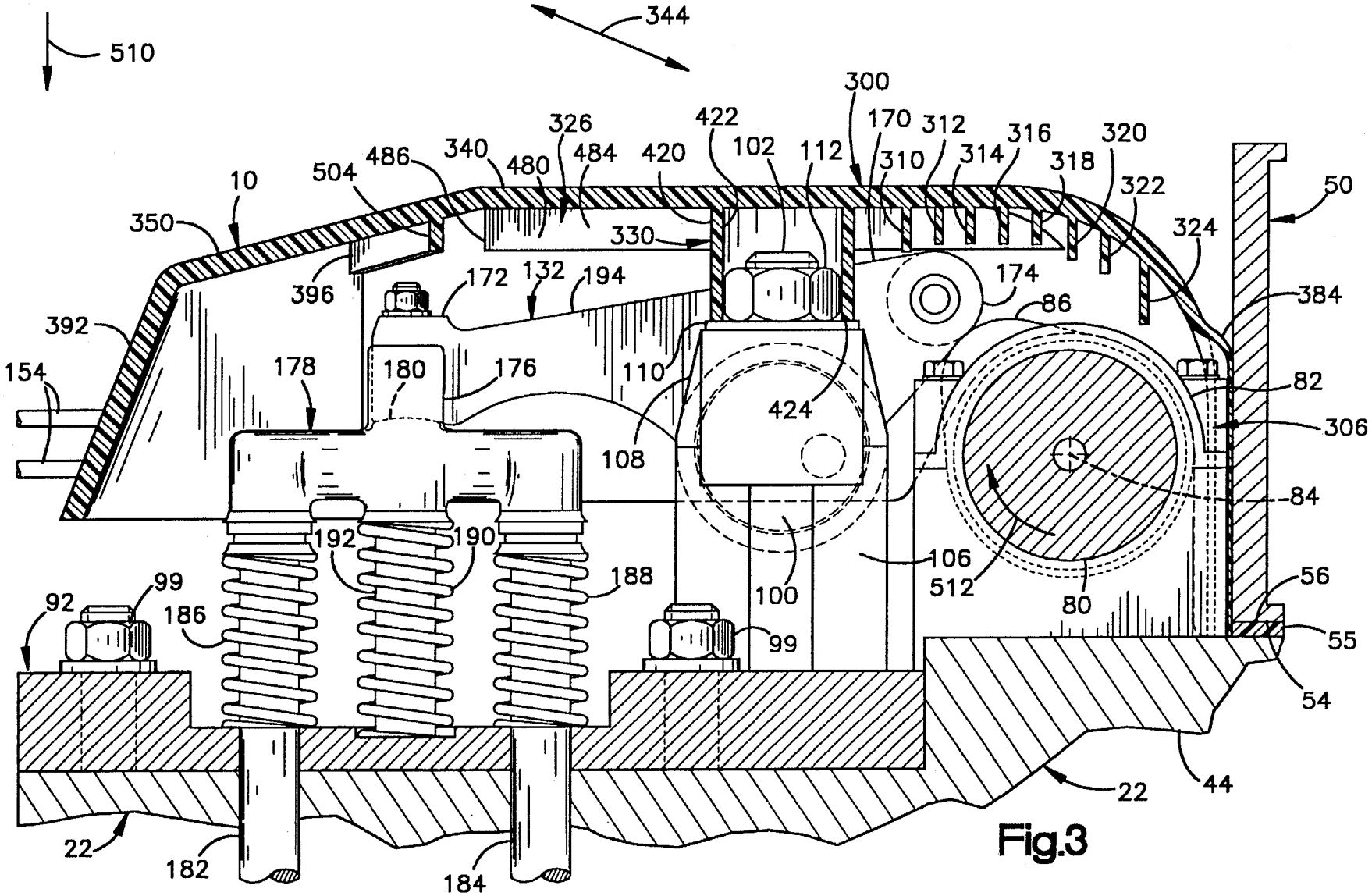
FIG. 3 is a view similar to FIG. 2 showing the relationship between the one cover and an exhaust valve actuator mechanism of the one cylinder assembly, taken generally along line 3—3 of FIG. 4.
Figure 4:
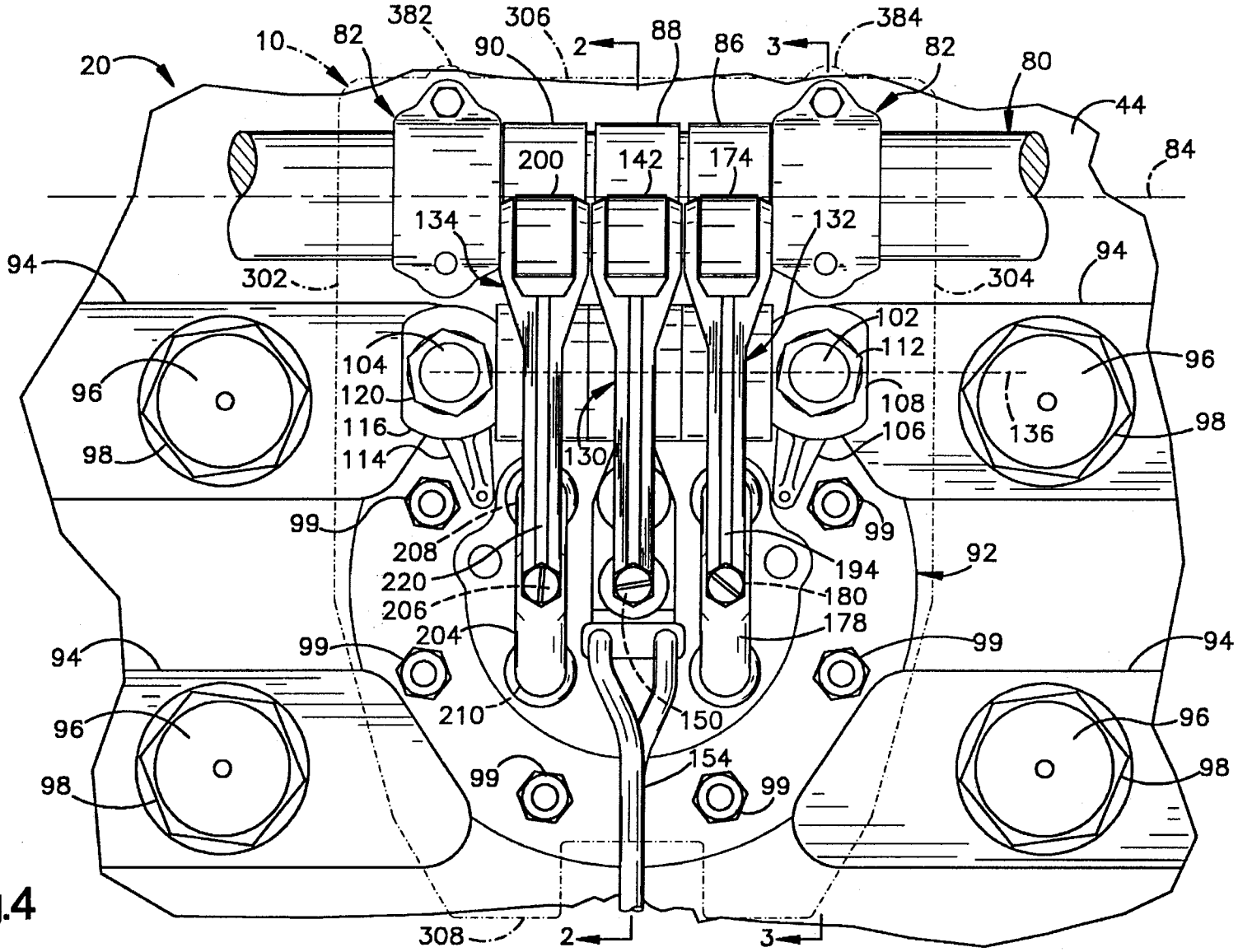
FIG. 4 is a simplified top plan view showing the relationship between the one cover and its associated cylinder assembly.
Figure 5:
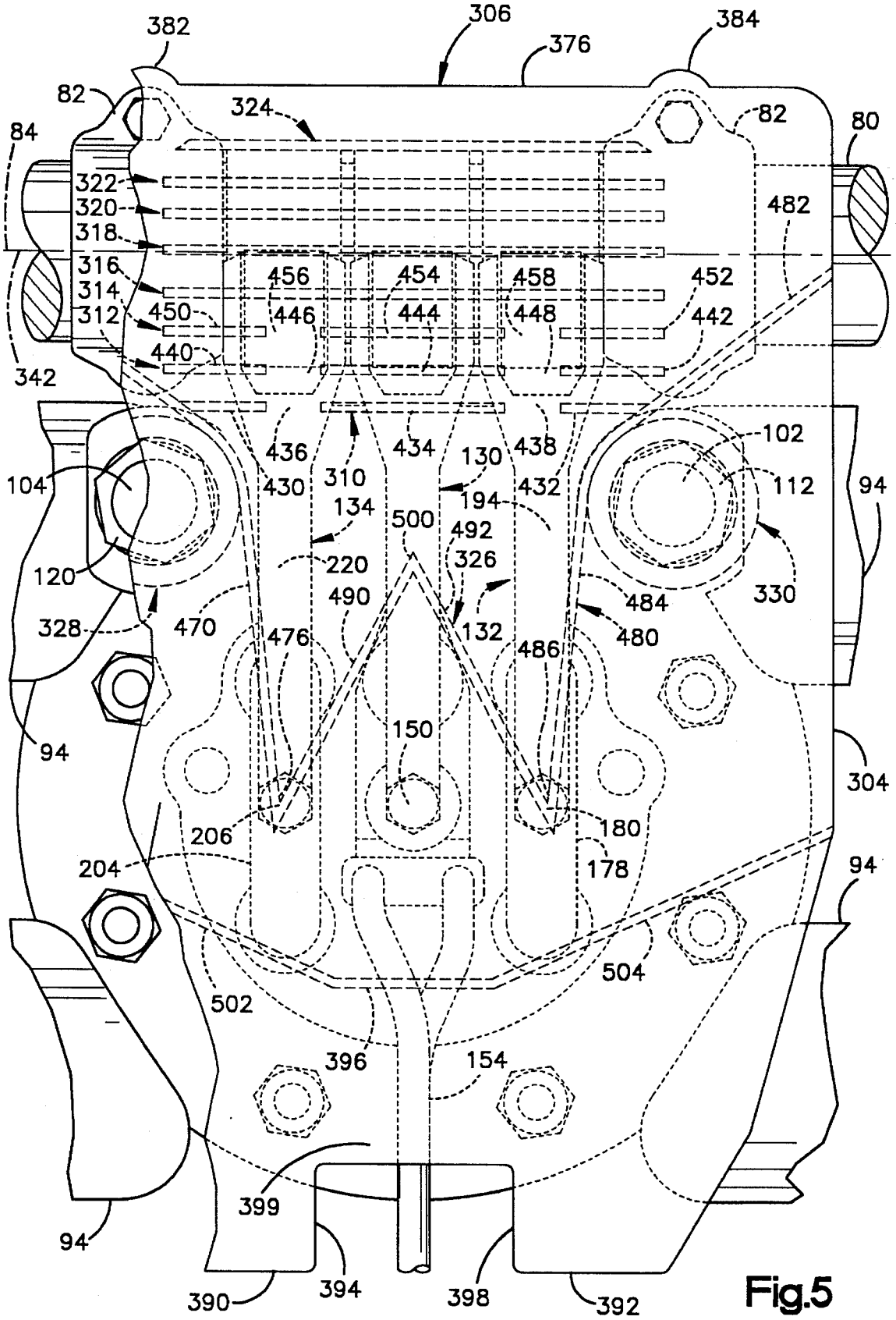
FIG. 5 is a view similar to FIG. 4.
Figure 6:
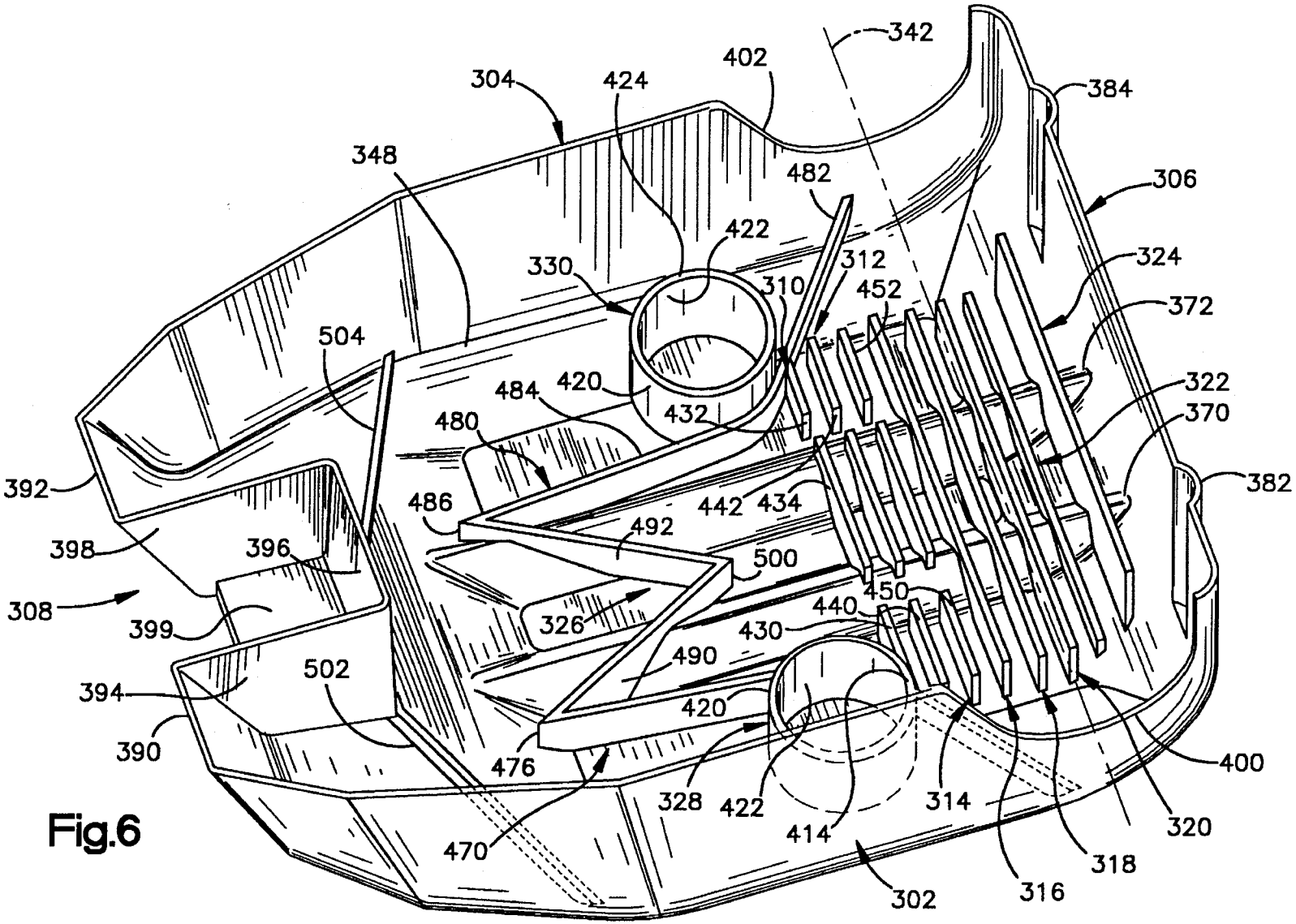
FIG. 6 is a bottom perspective view of a cover in accordance with the present invention.
Figure 7:
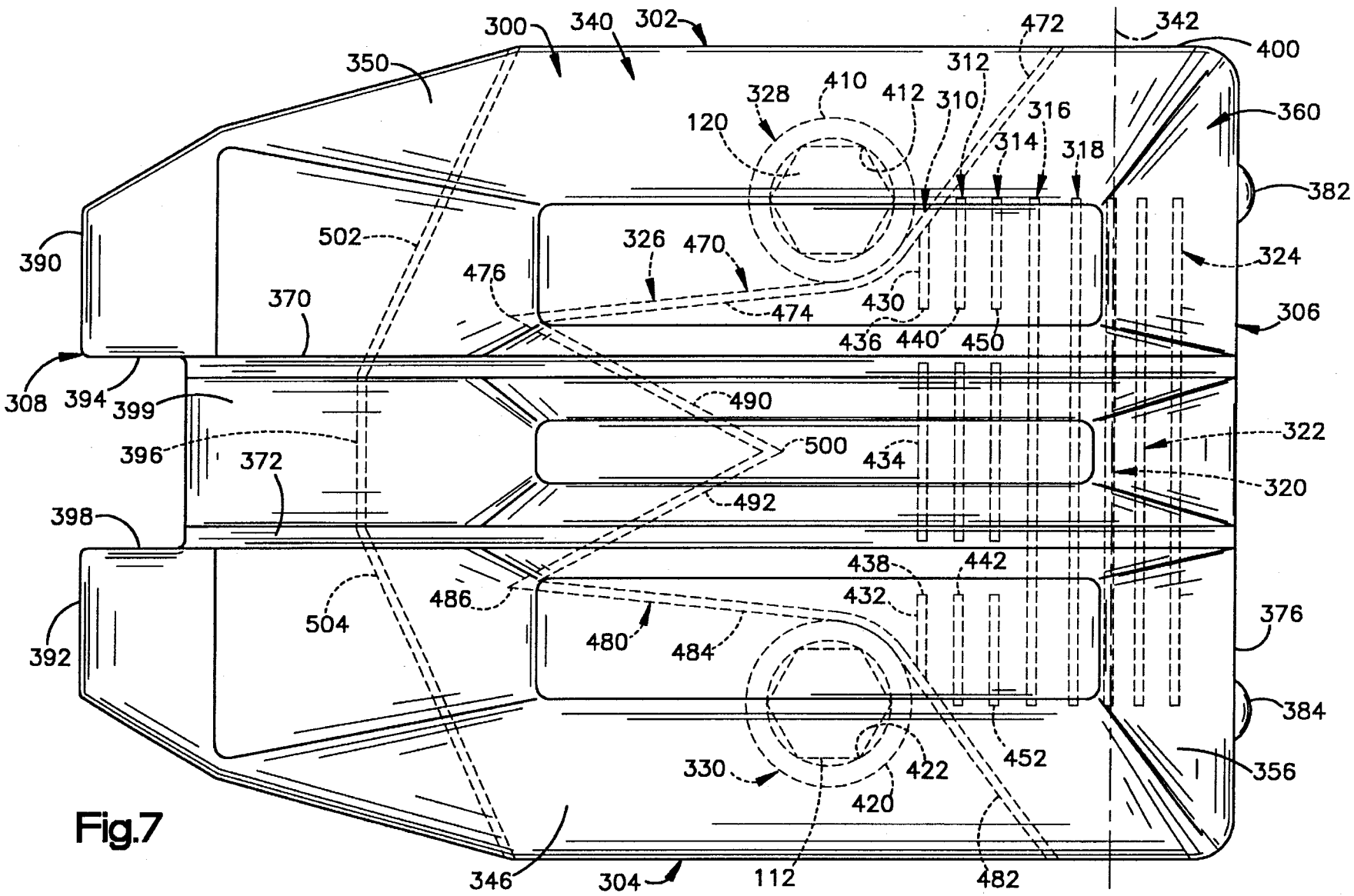
FIG. 7 is a top plan view of a cover in accordance with the present invention.

Associated with each cylinder bank 24 and 26 is an overhead camshaft 80 (FIGS. 2 and 4). A camshaft support assembly which is designated generally at 82 includes pads and bearings spaced along the length of the camshaft 80 which support the camshaft for rotation about a longitudinal central axis 84. At the location of each cylinder assembly 30 three cam lobes (FIG. 4) are fixed for rotation with the camshaft 80: a first exhaust valve lobe 86, an injector lobe 88, and a second exhaust valve lobe 90.

Each cylinder assembly 30 includes a cylinder head 92. Each cylinder head 92 is secured to the crankcase 22 by a plurality of plates or crabs 94 (FIG. 4) held down by crab bolts 96 and nuts 98. Each cylinder head 92 is secured to its corresponding cylinder liner by a plurality of cylinder head to liner fasteners 99, each of which includes a stud and a nut.

Each cylinder assembly 30 includes a rocker arm shaft 100 which extends parallel to the camshaft 80. The rocker arm shaft 100 is supported on the cylinder head 92 by a pair of rocker arm shaft support studs 102 and 104 which are turned into the cylinder head.

The rocker arm shaft support stud 102 (FIGS. 3 and 4) extends through a rocker arm shaft support 106 disposed under the rocker arm shaft 100 and a cap 108 disposed over the rocker arm shaft. A rocker arm shaft washer 110 is disposed on the rocker arm shaft cap 108. A hexagonal rocker arm shaft nut 112 is screwed on the stud 102.

The rocker arm shaft support stud 104 (FIG. 4) extends through a rocker arm shaft support 114 disposed under the rocker arm shaft 100 and a cap 116 disposed over the rocker arm shaft. A rocker arm shaft washer 122 (FIG. 2) is disposed on the rocker arm shaft cap 116. A hexagonal rocker arm shaft nut 120 is screwed on the stud 104.

The rocker arm shaft studs 102 and 104 of each cylinder assembly 30, and the rocker arm shaft nuts 112 and 120, project upward from the cylinder head 92 and the top deck 44. The rocker arm shaft nuts 112 and 120 have outer side surfaces which are engageable by a tool to rotate the nuts relative to the rocker arm shaft studs 102 and 104. At each cylinder assembly 30, a respective cover 10 is supported on the rocker arm shaft nuts 112 and 120 in a manner as described below in detail.

An injector rocker arm 130 (FIGS. 2 and 4) and two exhaust valve rocker arms 132 and 134 are mounted on the rocker arm shaft 100 for pivotal movement about the rocker arm shaft and about an axis 136 which extends parallel to the axis 84 of the camshaft 80. The injector rocker arm 130 is disposed intermediate the first and second exhaust valve rocker arms 132 and 134.

The injector rocker arm 130 (FIG. 2) has opposite inner and outer end portions 138 and 140. A follower in the form of a roller 142 is mounted on the inner end portion 138 of the injector rocker arm 130. The roller 142 is in rolling engagement with the injector lobe 88.

The outer end portion 140 (FIG. 2) of the injector rocker arm 130 pivotally engages the upper end portion 144 of a fuel injector 146 at a joint indicated schematically at 150. It should be understood that other parts of the valve train such as lash adjusters in the joint 150 are not shown. The outer end portion 140 of the injector rocker arm 130 has an upper surface 152 which faces away from the cylinder head 92.

Diesel fuel is supplied to the injector 146 in a known manner through a fuel supply system which includes fuel lines 154 and other parts not shown. The injector 146 is mounted in an injector body 156 secured to the cylinder head 92 by an injector crab 158 and an injector crab stud 160 and nut 162. The injector 146 is operable to inject fuel by parts (not shown) through a passage indicated schematically at 164 into a cylinder (not shown) of the engine 20.

The first exhaust valve rocker arm 132 (FIG. 3) has inner and outer end portions 170 and 172. A follower in the form of a roller 174 is mounted on the inner end portion 170 of the first exhaust valve rocker arm 132. The roller 174 is in rolling engagement with the first exhaust valve lobe 86.

The outer end portion 172 of the first exhaust valve rocker arm 132 pivotally engages the upper end portion 176 of a first exhaust valve bridge 178 at a joint indicated schematically at 180. The first exhaust valve bridge 178 actuates two first exhaust valves 182 and 184. The valves 182 and 184 are biased to a closed position by springs 186 and 188 around the valve stems and by a central spring 190 around a spring support 192. The outer end portion 172 of the first exhaust valve rocker arm 132 has an upper surface 194 which faces away from the cylinder head 92. The first exhaust valves 182 and 184 are operable in tandem to enable exhaust of products of combustion from the cylinder assembly 30 in a known manner.

The second exhaust valve train is identical to the first exhaust valve train and includes a second exhaust valve rocker arm 134 (FIG. 4). A follower in the form of a roller 200 is mounted on an inner end portion of the second exhaust valve rocker arm 134. The roller 200 is in rolling engagement with the second exhaust valve lobe 90.

The outer end portion of the second exhaust valve rocker arm 134 pivotally engages the upper end portion of a second exhaust valve bridge 204 (FIG. 4) at a joint indicated schematically at 206. The second exhaust valve bridge 204 actuates two second exhaust valves 208 and 210. The valves 208 and 210 are biased to a closed position by springs (not shown). The outer end portion of the second exhaust valve rocker arm 134 has an upper surface 220 which faces away from the cylinder head 92. The second exhaust valves 208 and 210 are operable to enable exhaust of products of combustion from the cylinder assembly 30 in a known manner.

Each cover 10 (FIGS. 2–3, 5–7) is preferably formed as one piece from a plastic material which will hold up under the known working conditions of the engine 20. Presently contemplated materials include fiberglass, plastic or polymeric materials, hard rubber, or metal such as aluminum. Each cover 10 could alternatively be made from a plurality of pieces joined together, rather than being made as one piece.

The cover 10 (FIGS. 2 and 6) has an open-bottom configuration and includes generally a top wall 300, first and second end walls 302 and 304, an inner wall 306 and an outer wall designated generally 308. A series of eight axial ribs 310–324 are disposed on the inside of (below as viewed in FIG. 2) the top wall 300 of the cover 10. A W-shaped rib 326 and a pair of support tubes 328 and 330 are also disposed on the inside of the top wall 300 of the cover 10.

The top wall 300 includes a generally planar central portion 340 (FIG. 2) which merges into the adjacent wall portions of the cover 10. The central portion 340 of the top wall 300 has an outer major side surface 346 and an opposite inner major side surface 348. The central portion 340 of the top wall 300 extends in a plane which is parallel to an axis 342 of the cover 10. The axis 342 of the cover 10 is coincident with the axis 84 of the camshaft 80 when the cover is mounted on the engine 20.

When the cover 10 is mounted on the engine 20, the central portion 340 of the top wall 300 of the cover extends generally parallel to the top deck 44 of the crankcase 22 of the engine. The top deck 44 of the crankcase 22 is inclined at an angle of about 22.5° to the horizontal in the engine 20 because of the vee configuration of the engine. Accordingly, the central portion 340 of the top wall 300 of the cover 10 also is inclined at a 22.5° angle to the horizontal. Thus, the cover 10, as a whole, extends or is inclined generally at a 22.5° angle to the horizontal, as shown by the arrow 344 (FIGS. 2, 3, and 8) which indicates a horizontal orientation.

A generally planar outer portion 350 of the top wall 300 of the cover 10 extends at an angle downward and outward (in a direction down and to the left as viewed in FIG. 2) from the central portion 340. The outer portion 350 has an outer major side surface 352 and an opposite inner major side surface 354.

An arcuate inner portion 356 of the top wall 300 curves downward and inward from the central portion 340 and merges into the inner wall 306 of the cover 10. The inner portion 356 of the top wall 300 has an outer major side surface 358 and an inner major side surface 360.

A pair of V-shaped strengthening ribs 370 and 372 (FIGS. 5–7) are formed in the top wall 300. The ribs 370 and 372 extend parallel to each other in a direction between the outer and inner walls 308 and 306 of the cover 10. The ribs 370 and 372 extend from the outer portion 350 of the top wall 300 through the central portion 340 and into the inner portion 356.

The major portion of the inner wall 306 of the cover 10 is generally planar in configuration and extends generally perpendicular to the plane of the central portion 340 of the top wall 300. The axial ends of the inner wall 306 are curved where the inner wall merges into the end walls 302 and 304 of the cover 10. The inner wall 306 has an outer major side surface 376 (FIG. 2) and an opposite inner major side surface 378. A planar bottom surface 380 of the inner wall 306 extends parallel to the axis 342 of the cover 10.

Two clearance ribs 382 and 384 project from the plane of the inner wall 306 in a direction away from the outer wall 308 of the cover 10. The clearance ribs 382 and 384 extend in a direction between the bottom surface 380 of the inner wall 306 and the top wall 300 of the cover 10. The clearance ribs keep the cover 10, to a large extent, out of direct contact with the inner wall 50 of the cylinder head cover support frame 42. This is desirable because the inner wall 50 of the cylinder head cover support frame 42 becomes very hot since the temperature on the outside (to the right as viewed in FIG. 2) of the inner wall of the cylinder head cover support frame can exceed 500° F. The cylinder head cover support frame 42 may alternatively be mounted so that the inner wall 50 actually touches the camshaft supports 82. In that case, the material of the inner wall 306 of the cover 10 may be cut away (removed) to form slots at the location of the clearance ribs 382 and 384, to enable placement of the inner wall of the cover between the inner wall 50 of the cylinder head cover support frame 42 and the camshaft supports 82.

The outer wall 308 of the cover 10 (FIG. 6) includes five interconnected wall portions 390–398. The outermost wall portions 390 and 392 extend inward from the end walls 302 and 304, respectively, and at an angle downward and outward from the outer portion 350 of the top wall 300. The wall portions 390 and 392 extend parallel to the axis 342. At the inner ends of the wall portions 390 and 392, the other wall portions 394,396, and 398 form a U-shaped central portion of the outer wall 308. A planar portion 399 of the top wall 300 covers the recess defined by the walls 394, 396 and 398.

The first end wall 302 (FIG. 6) of the cover 10 extends between the inner wall 306 and the wall portion 390 of the outer wall 308. A generally circular cutout 400 in the first end wall 302 receives the camshaft 80. The second end wall 304 of the cover 10 is a mirror image of the first end wall 302. The second end wall 304 extends between the inner wall 306 and the wall portion 392 of the outer wall 308. A generally circular cutout 402 in the second end wall 304 receives the camshaft 80.

The support tube 328 (FIGS. 2 and 5–7) projects downward from the central portion 340 of the top wall 300. The support tube 328 is cylindrical in configuration with parallel cylindrical outer and inner surfaces 410 and 412 extending perpendicular to the plane of the central portion 340 of the top wall 300. The diameter of the inner surface 412 of the support tube 328 is equal to or slightly less than the distance between 180° opposite points of the hexagonal rocker arm shaft nut 120 as measured along a straight line which extends through the center of the nut. An annular lower end surface 414 (FIGS. 2 and 6) of the support tube 328 extends parallel to the plane of the central portion 340 of the top wall 300. The distance between the end surface 414 of the support tube 328 and the inner surface 348 of the central portion 340 of the top wall 300 is selected to be somewhat greater than the combined height of the rocker arm shaft nut 120 and the portion (if any) of the rocker arm shaft stud 104 which projects from the nut.

The support tube 330 (FIGS. 3 and 5–7) is identical in construction to the support tube 328. The support tube 330 is cylindrical in configuration having parallel cylindrical outer and inner surfaces 420 and 422 which extend perpendicular to the plane of the central portion 340 of the top wall 300. The diameter of the inner surface 422 of the support tube 330 is equal to or slightly less than the distance between 180° opposite points of the hexagonal rocker arm shaft nut 112 as measured along a straight line which extends through the center of the nut. An annular lower end surface 424 (FIGS. 3 and 6) of the support tube 330 extends parallel to the plane of the central portion 340 of the top wall 300. The distance between the end surface 424 of the support tube 330 and the inner surface 348 of the central portion 340 of the top wall 300 is selected to be somewhat greater than the combined height of the rocker arm shaft nut 112 and the portion (if any) of the rocker arm shaft stud 104 which projects from the nut.

The axial ribs 310–324 (FIGS. 2–3, 5–7) on the cover 10 are eight in number and project downward from the central portion 340 and the inner portion 356 of the top wall 300 of the cover. The ribs 310–324 are generally planar in configuration and have a thickness about the same as the thickness of the walls 300–308 of the cover 10. The ribs 310–324 have longitudinal axes which extend parallel to each other and parallel to the axis 342 of the cover 10. Thus, the ribs 310–324 extend parallel to the camshaft 80 when the cover 10 is mounted on the engine 20. The ribs 310–324 also extend parallel to the inner wall 306 of the cover 10 in a direction between the end walls 302 and 304.

The three outermost axial ribs 310, 312, and 314 are substantially similar to each other. Each of the ribs 310–314 is separated by spaced apart gaps into three axially spaced rib portions. Specifically, the outermost axial rib 310 (FIGS. 5–7) includes a pair of end portions 430 and 432, and a central portion 434, separated by a pair of gaps 436 and 438. The adjacent axial rib 312 has a pair of outer portions 440 and 442, and a central portion 444, separated by gaps 446 and 448. The next adjacent axial rib 314 includes a pair of outer portions 450 and 452, and a central portion 454, separated by a pair of gaps 456 and 458. The remaining five axial ribs 316–324 each extend continuously in a direction across the width of the cover 10 without gaps.

The ribs 310–324 (FIGS. 2 and 3) are of varying height and extend downward from the cover 10 to varying distances above the parts of the cylinder assembly 30. The rib 310 is slightly taller than the ribs 312 and 314. The planar bottom surface of the rib 310 projects closer to the cylinder head 92 than do the ribs 312 and 314.

The ribs 316 and 318 are substantially the same height as the ribs 312 and 314, and have planar bottom surfaces spaced approximately the same distance from the plane of the central portion 340 of the top wall 300 of the cover 10. The rib 320 is approximately the same height as the ribs 316 and 318. However, the rib 320 projects downwardly from a location on the curved inner portion 356 of the top wall 340 which is farther from the plane of the central portion 340 of the top wall of the cover 10. Thus, the bottom surface of the rib 320 is disposed in a plane which is spaced below the plane of the bottom surfaces of the ribs 316 and 318.

Similarly, the rib 322 projects downward from a location on the inner portion 356 of the top wall 300 which is farther from the plane of the central portion 340 of the top wall of the cover 10. The rib 322 has a planar bottom surface disposed in a plane which is spaced below the bottom surface of the rib 320. Finally, the rib 324 projects downward from a location on the curved inner portion 356 of the top wall 340 which is farther from the plane of the central portion 340 of the top wall of the cover 10 than the portion from which the rib 322 projects. Also, the rib 324 is taller than the rib 322. Thus, the rib 324 extends closer to the cylinder head 92 than any of the other axial ribs 310–322.

The W-shaped rib 326 also projects downward from the central portion 340 and the inner portion 356 of the top wall 300 of the cover 10. The W-shaped rib 326 (FIGS. 5–7) includes a series of four interconnected legs 470, 480, 490 and 492 which form the W-shaped configuration of the rib 326. Each of the legs 470, 480, 490 and 492 has a thickness about the same as that of the walls 300–308 of the cover 10.

The first outer leg 470 of the W-shaped rib 326 includes first and second portions 472 and 474 which extend at an angle to each other. The first portion 472 of the leg 470 extends from about the end wall 302 adjacent the camshaft opening 400, to a location adjacent to and inward of the support tube 328. The second portion 474 of the first leg 470 extends from the end of the first portion 472 to a first point 476 of the W-shaped rib 326. The first point 476 is disposed about at the area of intersection between the central portion 340 of the top wall 300 and the outer portion 350 of the top wall.

The second outer leg 480 of the W-shaped rib 326 is a mirror image of the first outer leg 470. The second outer leg 480 includes first and second portions 482 and 484 which extend at an angle to each other. The first portion 482 of the leg 480 extends from about the end wall 304 adjacent the camshaft opening 402 to a location adjacent to and inward of the support tube 330. The second portion 484 of the leg 480 extends from the end of the first portion 482 to a second point 486 of the W-shaped rib 326. The second point 486 is disposed about at the junction between the central portion 340 and the outer portion 350 of the top wall 300 of the cover 10.

A first inner leg 490 of the W-shaped rib 326 extends inward from the first point 476 at an acute angle to the portion 474 of the first outer leg 470. A second inner leg 492 is a mirror image of the first inner leg 490 and extends inwardly from the second point 486 of the W-shaped rib 326 at an acute angle to the portion 484 of the second outer leg 480. The second inner leg 492 intersects and is connected with the first inner leg 490 at a third point 500 of the W-shaped rib 326. The third point 500 is disposed at a location equidistant between the end walls 302 and 304 of the cover 10.

Two angular ribs 502 and 504 of the cover 10 project downward from the outer portion 350 of the top wall 300 of the cover. The rib 502 extends between the first end wall 302 and the intersection of the portions 394 and 396 of the outer wall 308. The rib 504 is a mirror image of the rib 502 and extends between the second end wall 304 and the intersection between the portions 398 and 396 of the outer wall 308.

To mount a cover 10 on the engine 20, the cylinder head cover 60 is moved to an open position as shown in FIG. 1. The cover 10 is manually positioned over the exposed operating mechanism of a particular cylinder assembly 30 including the first and second exhaust valve rocker arms 132 and 134, the injector rocker arm 130, and the associated rocker arm shaft 100. The side walls 302 and 304 of the cover 10 can be grasped by hand with the fingers curled underneath the lower edge portions of the side walls.

The support tubes 328 and 330 are aligned over the rocker arm shaft nuts 120 and 112, respectively. The cover 10 is moved downward toward and perpendicular to the top deck 44 and cylinder head 92 of the engine 20, in a direction as indicated by the arrow 510 in FIG. 2. The support tubes 328 and 330 are press fit downward onto the rocker arm shaft nuts 120 and 112, respectively. The cover 10 is moved downward until the annular end surface 424 on the support tube 330 (FIG. 3) engages the rocker arm shaft support washer 110 and the annular end surface 414 on the support tube 328 (FIG. 2) engages the rocker arm shaft support washer 122.

As the support tubes 328 and 330 move over the rocker arm shaft nuts 120 and 112, the material of the cylindrical walls of the support tubes deforms to a small extent. Specifically, the hexagonal rocker arm shaft nut 120 engages the cylindrical inner surface 412 of the support tube 328. The points of the hexagonal rocker arm shaft nut 120 form an interference fit with the material of the support tube 328. Simultaneously, the hexagonal rocker arm shaft nut 112 engages the cylindrical inner surface 422 of the support tube 330. The points of the hexagonal rocker arm shaft nut 112 form an interference fit with the material of the support tube 330. This press fit engagement of the support tubes 328 and 330 with the rocker arm shaft nuts 120 and 112 holds the cover 10 in place relative to the engine 20.

With the cover 10 in position on the engine 20, the central portion 340 of the top wall 300 of the cover extends generally parallel to the plane of the cylinder head 92. The axial ribs 310–324 are disposed generally over the cam followers 142, 174 and 200 and over the cam lobes 86–90. The axial ribs 310–324 extend parallel to the axis 84 of the camshaft 80.

The gaps 436, 446 and 456 in the axial ribs 310–314, respectively, are disposed generally over the axial center of the second exhaust valve rocker arm follower 200. At this location the amount of spray from the follower 200 and its associated cam lobe 90 is least, as such spray tends to come from the axial ends (edges) of the follower and the cam lobe. The gaps 436, 446 and 456 therefore do not substantially affect the oil intercepting function of the ribs 310–314 as described below. The gaps 438, 448 and 458 in the axial ribs 310–314 are disposed generally over the axial center of the follower 174 and its associate cam lobe 86. At this location spray from the follower 174 and the cam lobe 86 is least because such spray tends to come off the axial ends (edges) of the follower and the lobe. The gaps 438, 448 and 458 therefore do not affect substantially the oil intercepting functions of the ribs 310–314 as described below.

The first point 476 (FIG. 5) of the W-shaped rib 326 is disposed over the upper surface 220 of the second exhaust valve rocker arm 134. Because of the 22.5° angle of inclination of the cover 10, the first point 476 is disposed approximately vertically over the joint 206 between the outer end portion of the second exhaust valve rocker arm 134 and the second exhaust valve bridge 204.

The second point 486 (FIG. 5) of the W-shaped rib 326 is disposed generally over the upper surface 194 of the first exhaust valve rocker arm 132. Because of the 22.5° angle of inclination of the cover 10, the second point 486 is disposed approximately vertically over the joint 180 between the inner end portion 172 of the first exhaust valve rocker arm 132 and the first exhaust valve bridge 178.

When the engine 20 is operated, the camshaft 80 rotates about the axis 84 in the direction indicated by the arrow 512 (FIG. 2). The cam lobes 86–90 rotate about the axis 84. As each cam lobe 86–90 engages its associated cam follower, the rocker arms 130–134 pivot about the rocker arm shaft 100.

Specifically, the first exhaust valve rocker arm 132 pivots about the rocker arm shaft 100 as the follower 174 is engaged by the cam lobe 86. The outer end portion 172 of the first exhaust valve rocker arm 132 moves down in a direction towards the first exhaust valve bridge 178. The force of the pivoting rocker arm 132 is transmitted through the pivot joint 180 into the first exhaust valve bridge 178. The first exhaust valve bridge 178 moves down in the direction toward the cylinder head 92, actuating the first exhaust valves 182 and 184. When the cam lobe 86 moves out from under the follower 174, the first exhaust valve rocker arm 132 pivots back to its unactuated position under the influence of the springs 186–190.

Simultaneously, the cam lobe 90 (FIG. 4) rotates about the camshaft axis into engagement with the follower 200, and the second exhaust valve rocker arm 134 pivots about the rocker arm shaft 100. The outer end portion of the second exhaust valve rocker arm 134 moves down in a direction toward the second exhaust valve bridge 204. The force of the moving rocker arm shaft 134 is transmitted through the pivot joint 206 into the second exhaust valve bridge 204. The second exhaust valve bridge 204 moves downward toward the cylinder head 92, actuating the second exhaust valves 208 and 210. When the cam lobe 90 rotates out from under the follower 200, the springs (not shown) associated with the second exhaust valves 208 and 210 cause the second exhaust valve rocker arm 134 to pivot back to its unactuated position.

When the injector cam lobe 88 rotates about the axis 84 into engagement with the follower 142 (FIG. 2), the injector rocker arm 130 pivots about the rocker arm shaft 100. The outer end portion 140 of the injector rocker arm 130 moves downward in a direction toward the cylinder head 92. The force of the moving injector rocker arm 130 is transmitted through the pivot joint 150 into the injector 144, actuating the fuel injection mechanism associated with the respective cylinder assembly 30. When the injector cam lobe 88 rotates out from under the follower 142, the injector rocker arm 130, under the influence of the spring on the injector 146, pivots about the rocker arm shaft 100 to its unactuated position.

As noted above, the camshaft 80 including the cam lobes 86–90 is supplied with lubricating oil through internal passages (not shown) in the engine 20. This lubricating oil flows onto the outer surfaces of the cam lobes 86–90 and onto the outer surface of the followers 142, 174 and 200. The camshaft 80 including the cam lobes 86–90, and the followers 142, 174 and 200, rotate sufficiently fast that a portion of the oil on the outer surface of these parts is sprayed off from these parts. The oil is sprayed in an approximately 270° pattern which encompasses the rocker arm shaft 100, the rocker arms 130–134, the followers 142, 174, and 200, and also the inner side wall 50 of the cylinder head cover support frame 42. Oil is also splashed from other moving parts such as the valve bridges.

The cover 10 intercepts oil which would otherwise be sprayed onto the cylinder head cover 60 and its support frame 42. This redirection of the intercepted oil minimizes contact of oil with the cylinder head cover 60 and its support frame 42 and minimizes consequent leakage of oil out of the enclosure formed by the cylinder head cover and its support frame. The oil which is intercepted is redirected onto specific parts of the engine 20 to lubricate and cool these parts.

Specifically, oil which is sprayed onto the inner surface of the top wall 300 of the cover 10, at the location of the axial ribs 310–324, engages the axial ribs. The axial ribs 310–324 block flow of the oil downward and outward along the inner side surface of the top wall 300. Instead, this oil collects in droplets on the axial ribs 310–324 and drips down off of the axial ribs onto the camshaft 80, the cam lobes 86–90, and the followers 142, 174 and 200. This portion of the oil sprayed off the cam lobes 86–90 and the followers 142, 174 and 200 is thereby redirected back onto the cam lobes and the followers to further lubricate and cool them.

The gaps in the axial ribs 310–324 allow a portion of the oil which is collected on the axial ribs to drain outwardly (to the left as viewed in FIGS. 2, 3 and 8) into the open center of the W-shaped rib 326. Specifically, oil can flow along the inner surface of the top wall 300 through the gap 456 (FIG. 5) in the rib 314, the gap 446 in the rib 312, and the gap 436 in the rib 310. Oil can also flow along the inner side surface of the top wall 300 of the cover 10 through the gap 438 in the rib 310, the gap 448 in the rib 312, and the gap 458 in the rib 314.

Because of the vee configuration of the engine 20, the central portion 340 of the top wall 30 of the cover 10 extends at a 22½° angle to the horizontal. Thus, oil which collects or is directed onto the inner surface of the central portion 340 of the top wall 300 of the cover 10 flows in an outward direction, that is, away from the camshaft 80 and toward the W-shaped rib 326.

The W-shaped rib 326 collects inside it oil which is sprayed onto the portions of the inner side surface of the top wall 300 which are disposed within the confines of the W-shaped rib. The W-shaped rib 326 also collects inside it the oil which travels down along the inner side surface of the top wall 300 of the cover 10 from the gaps 436, 446, 456 and 438, 448 and 458 in the axial ribs 310–314.

The W-shaped configuration of the rib 326 channels this oil into two portions. A first portion of the oil is directed into the inside of the V-shaped first point 476 of the rib 326. The first point 476 of the W-shaped rib 326 is disposed over the upper surface 220 of the second exhaust valve rocker arm 134. Because of the 22.5° angle of inclination of the cover 10, the first point 476 of the W-shaped rib 326 is disposed vertically over the joint 200 between the second exhaust valve rocker arm 134 and the second exhaust valve bridge 204. The oil which is collected in the first point 476 of the W-shaped rib 326 therefore drips vertically downward onto the upper surface 220 of the second exhaust valve rocker arm 134. This oil flows into the joint 206 between the second exhaust valve rocker arm 134 and the second exhaust valve bridge 204 to lubricate the joint 206. The lubricating oil minimizes wear of the joint 206 and also cools the parts which form the joint 206. The steady flow of oil onto the joint 206 between the second exhaust valve rocker arm 134 and the second exhaust valve bridge 204 enhances the pre-existing lubrication of the joint.

The second portion of the oil which is collected by the W-shaped rib 326 flows into the second point 486 of the W-shaped rib. The second point 486 of the W-shaped rib 326 is disposed over the upper surface 194 of the first exhaust valve rocker arm 132. Because of the 22.5° angle of inclination of the cover 10, the second point 486 is disposed vertically over the joint 180 between the outer end portion 172 of the first exhaust rocker arm 132 and the first exhaust valve bridge 178. The oil which is collected in the second point 486 of the W-shaped rib 326 therefore drops vertically downward onto the upper surface 194 of the first exhaust valve rocker arm 132. This oil flows down into the joint 180 between the first exhaust valve rocker arm 132 and the first exhaust valve bridge 178 to lubricate the joint. The steady flow of oil onto the joint 180 enhances the pre-existing lubrication of the joint.

The angular ribs 502 and 504 (FIG. 5) of the cover 10, together with the outer wall 308, contain, to a large extent, the remaining oil which flows or is sprayed outward under the cover 10. The ribs 502 and 504 and the outer wall 308 cause this oil to be directed downward onto the cylinder head 92 and the crankcase 22, rather than outward onto the cylinder head cover support frame 42. The cover 10 thereby blocks the direct flow of oil onto the outer side wall 52 (FIG. 8) of the cylinder head cover support frame 42. By minimizing the amount of oil sprayed onto the side wall 52 of the cylinder head cover support frame 42, less oil flows down the wall 52 to the outer gasket 58 located between the cylinder head cover support frame 42 and the crankcase 22. This minimizes leakage through the joint around the outer gasket 58 under the cylinder head cover support frame 42.

Figure 8:
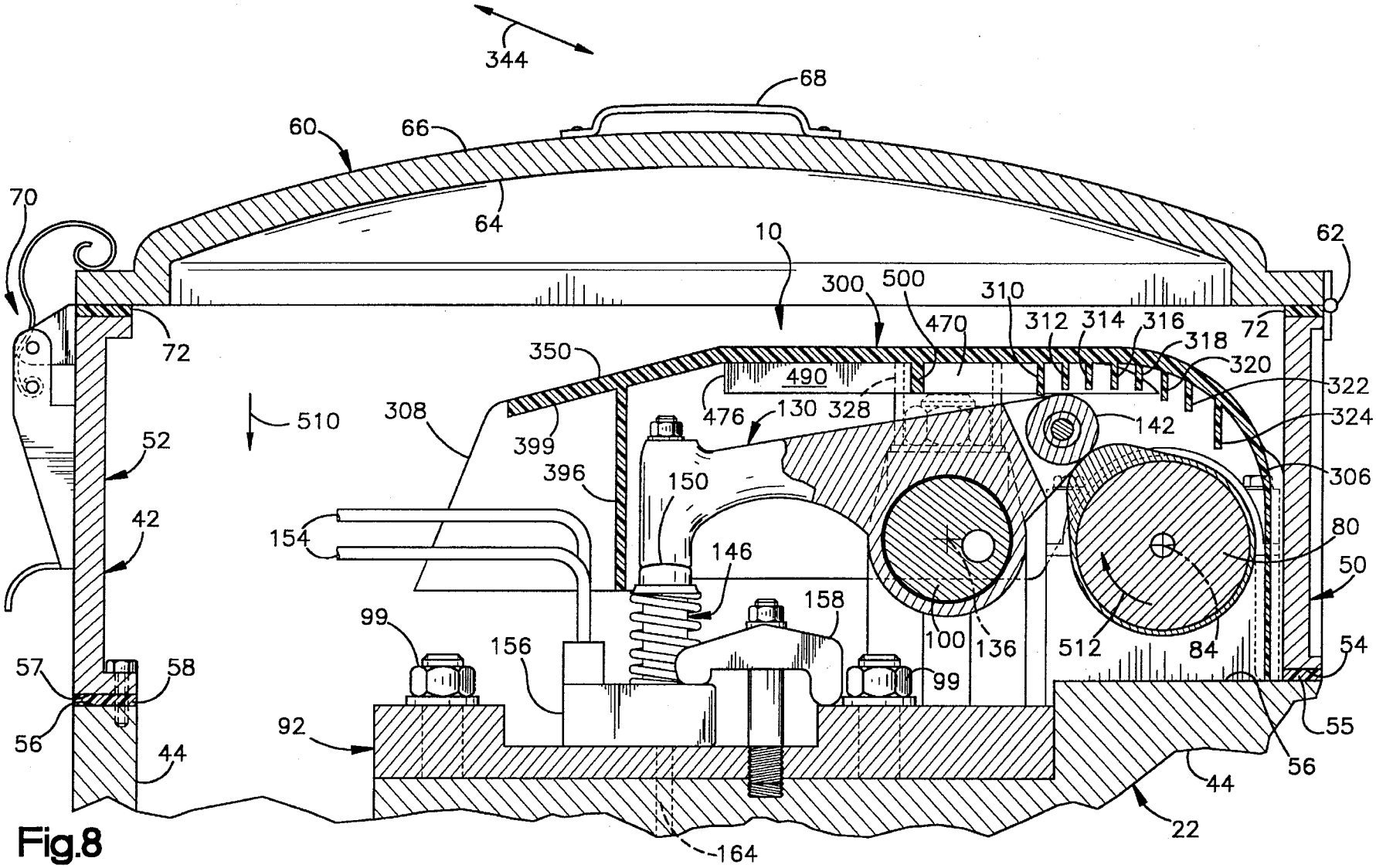
FIG. 8 is a view similar to FIG. 2 and showing also a cylinder head cover and support frame of the engine.

The inner wall 306 (FIG. 8) of the cover 10 intercepts oil which is sprayed inward, that is, in a direction to the right as viewed in FIG. 8. The inner wall 306 thereby blocks the direct flow of oil onto the inner side wall 50 of the cylinder head cover support frame 42. Oil is prevented from flowing down the inner side surface of the inner wall 50 of the cylinder head cover support frame 42 to the gasket 55 at the joint between the inner wall 50 and the crankcase top deck 44. This minimizes leakage around the gasket 55 and minimizes waste of oil. This also minimizes passage of oil onto the exhaust system components of the engine (not shown) which are generally disposed in the vee 28 (FIG. 1) adjacent to and inward of the inner wall 50 of the cylinder head cover support frame 42. Oil which passes onto these exhaust system components can be burned externally or can be aspirated into the engine exhaust parts at the engine vee 28, resulting in air pollution. By minimizing flow of oil onto the inner side wall 50 of the cylinder head cover support frame 42, the cover 10 of the present invention thereby minimizes leakage of oil and environmental damage such as air pollution.

The top wall 300 of the cover 10 intercepts oil which is sprayed in a direction upward as viewed in FIG. 8 toward the cylinder head cover 60. The cover 10 thus reduces the amount of oil which is sprayed onto the inner side surface 64 of the cylinder head cover 60. This reduces the flow of oil along the inner side surface 64 of the cylinder head cover 60 to the parts of the cylinder head cover support frame 42 including the outer wall 52 and the inner wall 50. This reduction in oil flow minimizes leakage around the gasket 72 between the cylinder head cover 60 and the cylinder head cover support frame 42. The flow of oil down the side walls 50 and 52 of the cylinder head cover support frame 42 to the crankcase 22 is also reduced.

In a preferred embodiment of the invention, one respective cover 10 is associated with each respective cylinder assembly 30 in the engine 20. Thus, a plurality of the covers 10 are disposed underneath each cylinder head cover 60. Specifically, as illustrated in FIG. 1, for a 16-cylinder engine, four covers 10 are disposed under each cylinder head cover 60.

It should be understood that the cover 10 does not seal against the engine 20. The end walls 302 and 304 of the cover 10 do not engage the cylinder 92 or the crankcase top deck 44. The outer wall 308 of the cover 10 does not engage the cylinder head 92 or the crankcase top deck 44. Thus, the cover 10 does not form a sealed enclosure when mounted on the engine 20. The lower end surface 380 of the inner wall 306 of the cover 10 may, although it is not necessary, engage the upper side surface 56 of the top deck 44 of the crankcase 22. This engagement can help to block flow of oil onto the gasket 54 between the inner side wall 50 of the cylinder head cover support frame 42 and the crankcase top deck 44. However, at all other locations except for the support tubes 328 and 330, the cover 10 is spaced apart from the engine 20. Accordingly, no close tolerances or special seals are required for the cover 10 to serve its desired lubricating function. Also, no separate fasteners are needed to secure the cover 10 to the engine 20. Thus, the engine 20 need not be modified in any way to accept the cover 10.

To remove a cover 10 from the engine 20, the lower edge portions of the side walls 302 and 304 are manually grasped. The cover 10 is lifted upwardly, that is, in a direction away from the cylinder head 92 and the crankcase top deck 44. The support tubes 328 and 330 slide along the rocker arm shaft nuts 120 and 112, respectively.

Various modifications are possible in the structure of the cover 10 while maintaining the functions of the cover. For example, the configuration of the rib 326 can be different, such as an "X" or a pair of "Vs" rather than a "W", so long as it provides locations for collecting oil and dripping the collected oil down onto the joints between the exhaust valve rocker arms and the exhaust valve bridges. Also, the configuration, number and spacing of the axial ribs 310–324 can be different, so long as the axial ribs collect oil above the camshaft 80 and drip the collected oil down onto the camshaft. For example, the rib 310 can be the same height as the ribs 312 and 314 for space considerations.

Further, the configuration of the support tubes 328 and 330 can be different. For example, the support tubes 328 and 330 might have a hexagonal inner configuration to match the hexagonal outer configuration of the rocker arm shaft nuts 112 and 120. In that case, the rocker arm shaft nuts 112 and 120 would have to be aligned to a particular rotational position on the rocker arm shaft support studs 102 and 104 to engage the hexagonal inner configuration of the support tubes 328 and 330. Alternatively, the support tubes 328 and 330 might have a knurled or multi-notched inner configuration. Also, if desired, a cover 10 may have a smooth inner surface, without any oil-collecting ribs, so as to stop oil leakage only.

From the above description of the invention, those skilled in the art will perceive improvements, changes and modifications in the invention. Such improvements, changes and modifications within the skill of the art are intended to be covered by the appended claims.

Having described the invention, I claim:

1. A cover for use on a multi-cylinder internal combustion engine having a rotatable overhead camshaft and having associated with each respective cylinder (i) an operating mechanism for operating one or more engine parts in response to rotation of said camshaft and (ii) a pair of projecting members disposed adjacent to the operating mechanism of the cylinder with which the members are associated, the camshaft being supplied with lubricating oil a portion of which sprays when the camshaft rotates, said cover is for use in association with a respective one of the cylinders, said cover comprising:

a wall for intercepting oil sprayed from the camshaft; and a pair of tubular projections connected with said wall and engageable in a press fit relationship with the projecting members for supporting said wall in a position adjacent to the camshaft.

2. A cover as set forth in claim 1 wherein each one of said tubular projections comprises a wall having a circular cross-sectional configuration with a cylindrical inner surface defining a cylindrical central opening in said tubular projection, said wall being made from a deformable material which deforms upon engagement with the projecting member.

3. A cover as set forth in claim 2 wherein the projecting members are fasteners having a multi-sided configuration, said deformable material surrounding the fasteners in a press-fit relationship.

4. A cover as set forth in claim 1 for use on an engine having a multi-cylinder head cover and a support frame together enclosing at least a portion of the camshaft and the operating mechanism and the pair of projecting members, wherein said wall of said cover comprises an upper wall of said cover for location above the projecting members, said cover further comprising at least an inner wall and an outer wall each connected with said upper wall for blocking flow of oil from the camshaft to the multi-cylinder head cover and the support frame.

5. A cover as set forth in claim 1 wherein said wall when supported in the position adjacent to the camshaft includes a plurality of ribs projecting inward from said wall in a direction toward the camshaft and the operating mechanism, said ribs having surfaces for collecting oil sprayed onto said wall, said ribs having collection portions for location above wear joints of the engine when said wall is supported by said tubular projections in the position adjacent to the camshaft.

6. A cover as set forth in claim 5 wherein said ribs include a plurality of ribs extending in a direction between end walls of said cover and supportable by said tubular supports over the cam, said plurality of ribs including surfaces defining gaps in at least one of said ribs for channeling oil to one or more of said collection portions of said cover.

7. A cover for use on a multi-cylinder internal combustion engine having a rotatable overhead camshaft and having associated with each respective cylinder (i) an operating mechanism for operating one or more engine parts in response to rotation of said camshaft and (ii) a pair of projecting members disposed adjacent to the operating mechanism of the cylinder with which the members are associated, the camshaft being supplied with lubricating oil a portion of which sprays from the camshaft when the camshaft rotates, said cover is for use in association with a respective one of the cylinders, said cover comprising:

a plurality of walls including a top wall, said plurality of walls for at least partially enclosing the operating mechanism with which said cover is associated;

a plurality of ribs projecting inward from said top wall for intercepting and collecting oil sprayed from the camshaft and for dripping the collected oil down onto the operating mechanism with which said cover is associated;

a pair of projecting portions connected with said top wall and engageable in a press fit relationship with the projecting members on the engine for supporting said wall in a position adjacent to the camshaft;

at least some of said plurality of walls having lower end portions which are spaced from the engine and which are not in sealing engagement with the engine when said projecting portions are engaged in the press fit relationship with the projecting members on the engine; and a collecting rib projecting inward from said top wall and having collection points for collecting oil flowing along the inside of said top wall and for dripping the oil from the collection points onto selected portions of the operating mechanism with which said cover is associated.

8. An apparatus comprising:

(a) a multi-cylinder internal combustion engine having a rotatable overhead camshaft and having associated with each respective cylinder an operating mechanism for operating one or more engine parts in response to rotation of said camshaft, said camshaft being supplied with lubricating oil a portion of which sprays when the camshaft rotates;

(b) a multi-cylinder cover assembly enclosing at least a portion of said camshaft and a plurality of adjacent operating mechanisms; and (c) a plurality of single-cylinder covers disposed within said multi-cylinder cover assembly for use in association with respective ones of said plurality of adjacent operating mechanisms;

each one of said single-cylinder covers comprising (1) a first wall for intercepting oil sprayed as a result of rotation of said camshaft and for directing the sprayed oil onto the respective one of said plurality of adjacent operating mechanisms with which said single-cylinder cover is associated, and (2) support means connected with said first wall for supporting said first wall in a position adjacent to the respective one of said plurality of adjacent operating mechanisms with which said single-cylinder cover is associated;

each one of said single-cylinder covers including a series of axial ribs which extend parallel to said camshaft, said axial ribs being disposed generally above said camshaft, said axial ribs having surfaces for collecting oil sprayed from said camshaft and for redirecting the collected oil onto parts of the engine to lubricate the engine parts, said axial ribs having surfaces defining gaps in at least one of said ribs for channeling oil collected on said axial ribs to a location spaced apart from said axial ribs.

9. An apparatus comprising:

(a) a multi-cylinder internal combustion engine having a rotatable overhead camshaft and having associated with each respective cylinder an operating mechanism for operating one or more engine parts in response to rotation of said camshaft, said camshaft being supplied with lubricating oil a portion of which sprays when the camshaft rotates;

(b) a multi-cylinder cover assembly enclosing at least a portion of said camshaft and a plurality of adjacent operating mechanisms; and (c) a plurality of single-cylinder covers disposed within said multi-cylinder cover assembly for use in association with respective ones of said plurality of adjacent operating mechanisms;

each one of said single-cylinder covers comprising (1) a first wall for intercepting oil sprayed as a result of rotation of said camshaft and for directing the sprayed oil onto the respective one of said plurality of adjacent operating mechanisms with which said single-cylinder cover is associated, and (2) support means connected with said first wall for supporting said first wall in a position adjacent to the respective one of said plurality of adjacent operating mechanisms with which said single-cylinder cover is associated;

each one of said single-cylinder covers including a collector rib formed on the inside of said first wall, said collector rib having points for collecting oil flowing along the inside of said collector rib and for dripping the oil from the points down onto selected portions of said operating mechanism of said cylinder with which said cover is associated, said collector rib having a generally W-shaped configuration.

10. A plurality of covers for use on a multi-cylinder internal combustion engine having a rotatable overhead camshaft and having associated with each respective cylinder an operating mechanism for operating one or more engine parts in response to rotation of the camshaft, the camshaft being supplied with lubricating oil a portion of which sprays from the camshaft when the camshaft rotates, each one of said plurality of covers for use in association with a respective one of the cylinders, each one of said covers comprising:

a plurality of outer walls for intercepting oil sprayed from said camshaft; and support means connected with said walls for supporting said walls in a position adjacent to the selected one of the cylinders;

at least some of said outer walls of each one of said covers having lower end portions for location spaced from the engine and not in sealing engagement with the engine when said covers are supported in position adjacent to the cylinders;

said plurality of outer walls of each one of said covers form respective inner enclosures enclosing the respective operating mechanisms with which said covers are associated, said plurality of outer walls of each one of said covers including a top wall and a series of interconnected side walls connected with said top wall and depending from said top wall to form said inner enclosure with an open-bottomed configuration;

each one of said covers having an inner one of said side walls which has a lower end portion engageable with the engine to block flow of oil past said inner side wall.

11. A cover for use on a multi-cylinder internal combustion engine having a rotatable overhead camshaft and having associated with each respective cylinder an operating mechanism for operating one or more valves in response to rotation of the camshaft, the camshaft being supplied with lubricating oil a portion of which sprays from the camshaft when the camshaft rotates, said cover being for use in association with a respective one of the cylinders, said cover comprising:

at least one upper wall for intercepting oil sprayed from the camshaft;

support means connected with said wall for supporting said upper wall in a position above the camshaft and adjacent to the selected one of the cylinders; and a plurality of ribs projecting inward from said upper wall and extending generally parallel to the camshaft for intercepting and collecting oil sprayed from the camshaft and for dripping the collected oil down onto the operating mechanism with which said cover is associated, said plurality of ribs including surfaces defining at least two gaps in at least one of said parallel ribs for channeling oil collected on said ribs to a location spaced apart from said ribs.

12. A cover as set forth in claim 11 further comprising a collector rib having surfaces defining two collection points, said collection points being disposed on said cover wall at a location spaced apart from said parallel ribs, each one of said collection points being associated with a respective one of said gaps in said parallel ribs.

13. An apparatus comprising an internal combustion engine having an upper portion, an overhead camshaft connected with and rotatable relative to said upper portion of said engine, a plurality of rocker arms movable by said camshaft, a rocker arm support assembly interconnecting said rocker arms and said upper portion of said engine, said rocker arm support assembly including first and second fasteners each of which has an outer side surface adapted to be engaged by a tool, and a cover extending over said camshaft and said rocker arms, said cover having a first connector portion which extends around the outer side surface of said first fastener and a second connector portion which extends around the outer side surface of said second fastener to retain said cover in a desired position relative to the upper portion of said engine during operation of said engine.

14. An apparatus as set forth in claim 13 wherein said cover includes an inner side surface which is engaged by lubricating liquid during operation of said engine, said cover including a first longitudinally extending rib section which extends along the inner side surface of said cover in a direction away from said camshaft to a location over an outer end portion of one of said rocker arms and a second longitudinally extending rib section which extends along the inner side surface of said cover in a direction away from said camshaft and transverse to said first longitudinally extending rib section to the location over the outer end portion of said one of said rocker arms, said first and second rib sections being effective to direct a flow of lubricating liquid away from said camshaft toward the location over the outer end portion of said one of said rocker arms during operation of said engine.

15. An apparatus as set forth in claim 13 wherein said cover includes an inner side surface which is engaged by lubricating liquid during operation of said engine, and a longitudinally extending rib which extends along the inner side surface of said cover and is disposed above said camshaft, said longitudinally extending rib being effective to promote downward dripping of lubricating liquid from the inner side surface of said cover toward said camshaft during operation of said engine.

16. An apparatus as set forth in claim 13 wherein said cover includes first and second wall portions which extend transversely to said camshaft and an upper wall portion which extends between said first and second wall portions, said first wall portion including surface means for defining a first recess through which said camshaft extends, said second wall portion including surface means for defining a second recess through which said camshaft extends, said first connector portion extends downward from said upper wall portion at a location adjacent to said first wall portion, said second connector portion extends downward from said upper wall portion at a location adjacent to said second wall portion.

17. An apparatus as set forth in claim 13 wherein said cover includes an inner side surface which is engaged by lubricating liquid during operation of the engine, a first longitudinally extending rib section which extends along the inner side surface of said cover and away from said first connector portion, and a second longitudinally extending rib section which extends along the inner side surface of said cover and away from said second connector portion, said first and second rib sections being effective to direct a flow of lubricating liquid away from said first and second connector portions during operation of the engine.

18. An apparatus as set forth in claim 13 wherein said first connector portion includes a first tubular section which extends around the outer side surface of the first fastener, said second connector portion includes a second tubular section which extends around the outer side surface of the second fastener.

19. An apparatus as set forth in claim 13 wherein said first connector portion includes a surface which at least partially defines a first recess in which at least a portion of said first fastener is received and which engages the outer side surface of said first fastener, said second connector portion including a surface which at least partially defines a second recess in which at least a portion of said second fastener is received and which engages the outer side surface of said second fastener.

20. An apparatus as set forth in claim 13 wherein said cover includes an upper wall portion, first and second end wall portions which extend downward from said upper wall portion, said first and second end wall portions extending transversely to said camshaft, an inner wall portion which extends downward from said upper wall portion adjacent to said camshaft and extends along at least a portion of said camshaft, said inner wall portion extends between said first and second end wall portions, and an outer wall portion which extends downward from said upper wall portion and extends between said first and second end wall portions at a location opposite from said inner wall portion, said first connector portion extends downward from said upper wall portion at a location adjacent to said first end wall portion and spaced from said inner wall portion and said outer wall portion, said second connector portion extends downward from said upper wall portion at a location adjacent to said second end wall portion and spaced from said inner wall portion and said outer wall portion.

21. An apparatus as set forth in claim 20 wherein said first end wall portion includes a lower edge portion which at least partially defines an open gap between said first end wall portion and said upper portion of said engine, said second end wall portion includes a lower edge portion which at least partially defines an open gap between said second end wall portion and said upper portion of said engine, said outer wall portion includes a lower edge portion which at least partially defines an open gap between said outer wall portion and said upper portion of said engine.

22. An apparatus as set forth in claim 20 wherein said upper wall portion of said cover is engaged by lubricating liquid during operation of the engine, said cover further includes a plurality of rib sections which extend downward from said upper wall portion at locations disposed between said inner wall portion and said first and second connector portions, said rib sections being effective to promote downward dripping of lubricating liquid from said upper wall portion of said cover at locations spaced from said inner wall portion of said cover during operation of the engine.

23. An apparatus as set forth in claim 20 wherein said upper wall portion of said cover is engaged by lubricating liquid during operation of the engine, said cover further includes a plurality of rib sections which extend downward from said upper wall portion at locations disposed between said outer wall portion and said first and second connector portions, said rib sections being effective to promote downward dripping of lubricating liquid from said upper wall portion of said cover at locations spaced from said outer wall portion of said cover during operation of the engine.

24. An apparatus comprising an internal combustion engine having an upper portion, an overhead camshaft connected with and rotatable relative to said upper portion of said engine, a plurality of rocker arms movable by said camshaft, and a cover connected with said upper portion of said engine and extending over at least a portion of said camshaft and said rocker arms, said cover including an upper wall portion which is engaged by lubricating liquid during operation of said engine, a first end wall portion which extends downward from said upper wall portion and which has a lower edge portion which at least partially defines an open gap between said first end wall portion and said upper portion of said engine, a second end wall portion which extends downward from said upper wall portion and which has a lower edge portion which at least partially defines an open gap between said second end wall portion and said upper portion of said engine, an inner wall portion which extends downward from said upper wall portion adjacent to said camshaft and extends along at least a portion of said camshaft, an outer wall portion which extends downward from said upper wall portion and which has a lower edge portion which at least partially defines an open gap between said outer wall portion and said upper portion of said engine, and a plurality of rib sections which extend downward from said upper wall portion, said rib sections being effective to promote downward dripping of lubricating liquid from said upper wall portion of said cover toward said camshaft and rocker arms during operation of said engine.

25. An apparatus as set forth in claim 24 wherein said internal combustion engine further includes a rocker arm mounting assembly which mounts said rocker arms on said upper portion of said internal combustion engine, said cover further including a first connector portion which extends downward from said upper wall portion and engages said rocker arm mounting assembly and a second connector portion which extends downward from said upper wall portion and engages said rocker arm mounting assembly, said first and second connector portions cooperating with said rocker arm mounting assembly to position said cover relative to said upper portion of said engine.

26. An apparatus as set forth in claim 24 wherein said plurality of rib sections includes a first group of longitudinally extending rib sections which is at least partially disposed above said camshaft and promotes downward dripping of lubricating liquid from said upper wall portion of said cover toward said camshaft during operation of said engine, said plurality of rib sections further includes a second group of longitudinally extending rib sections which is at least partially disposed above said rocker arms and promotes downward dripping of lubricating liquid from said upper wall portion of said cover toward said rocker arms during operation of said engine, at least some of said rib sections in said second group of rib sections having longitudinal axes which extend transverse to longitudinal axes of at least some of said rib sections in said first group of rib sections.

27. An apparatus as set forth in claim 26 wherein said rib sections of said first group of rib sections have longitudinal central axes which extend transversely to said first and second end wall portions.

28. An apparatus as set forth in claim 24 wherein said rib sections include first and second rib sections which have transverse longitudinal axes and which intersect at a location above a first one of said rocker arms and promote downwardly dripping of lubricating liquid from the location where said first and second rib sections intersect toward said first one of said rocker arms, said rib sections further including third and fourth ribs sections which have transverse longitudinal axes and which intersect at a location above a second one of said rocker arms and promote downward dripping of lubricating liquid from the location where said third and fourth rib sections intersect toward said second one of said rocker arms.

29. An apparatus as set forth in claim 24 wherein said lower edge portion of said first end wall defines a first recess which opens downward toward said upper portion of said engine and through which said camshaft extends, said lower edge portion of said second end wall defines a second recess which opens downward toward said upper portion of said engine and through which said camshaft extends.

30. An apparatus as set forth in claim 24 wherein said plurality of rib sections includes a group of rib sections which extend along said upper wall and are disposed above said camshaft.

31. An apparatus comprising an internal combustion engine having an upper portion, a plurality of cylinders connected with said upper portion of said engine and disposed in a linear array, an overhead camshaft having a length which is at least substantially as great as a length of said linear array of cylinders and extending along said upper portion of said engine adjacent to each of said cylinders in said linear array of cylinders, a plurality of rocker arm assemblies, each of said rocker arm assemblies being disposed adjacent to one of said cylinders in said linear array of cylinders and being connected with said upper portion of said engine, each of said rocker arm assemblies being actuatable by said camshaft during operation of said engine, a plurality of inner covers disposed in a linear array having a length which is at least as great as the length of said linear array of cylinders, each of said inner covers in said linear array of inner covers having first and second recesses which open downward toward said upper portion of said engine and through which said camshaft extends, each of said inner covers in said linear array of inner covers enclosing at least one of said rocker arm assemblies and a portion of said camshaft, and an outer cover which extends over each of said inner covers in said linear array of inner covers, said outer cover having a length which is at least as great as the length of said linear array of inner covers, said outer cover being movable relative to said upper portion of said engine between a closed position extending over said linear array of inner covers and an open position to provide access to said linear array of inner covers.

32. An apparatus as set forth in claim 31 wherein each one of said inner covers in said linear array of inner covers includes mounting apparatus which slidably engages one of said rocker arm assemblies, said mounting apparatus for each one of said inner covers in said linear array of inner covers being engageable with one of said rocker arm assemblies by manually pushing said one of said inner covers toward said one of said rocker arm assemblies and being disengageable from said one of said rocker arm assemblies by manually pulling said one of said inner covers away from said one of said rocker arm assemblies.

33. An apparatus as set forth in claim 31 wherein each one of said inner covers in said linear array of inner covers includes an upper wall portion, a first end wall portion which extends downward from said upper wall portion, a second end wall portion which extends downward from said upper wall portion, an inner wall portion which extends downward from said upper wall portion, and an outer wall portion which extends downward from said upper wall portion, said first end wall portion of said one inner cover having a lower edge portion which defines said first recess in said one of said inner covers, said second end wall portion of said one inner cover having a lower edge portion which defines said second recess in said one of said inner covers.

34. An apparatus comprising an internal combustion engine having an upper portion, an overhead camshaft connected with and rotatable relative to said upper portion of said engine, a rocker arm assembly actuatable by said camshaft during operation of said engine, a cover extending over said camshaft and said rocker arm assembly, and a connector assembly extending between said cover and said rocker arm assembly to position said cover relative to said upper portion of said engine, said connector assembly including a surface area which is slidable along a portion of said rocker arm assembly during engagement of said connector assembly with said rocker arm assembly and during disengagement of said connector assembly from said rocker arm assembly, said connector assembly being engageable with said rocker arm assembly by manually pushing said cover toward said rocker arm assembly to slide said surface area on said connector assembly in a first direction along said portion of said rocker arm assembly, said connector assembly being disengageable from said rocker arm assembly by manually pulling said cover away from said rocker arm assembly to slide said surface area on said connector assembly in a second direction along said portion of said rocker arm assembly.

35. An apparatus as set forth in claim 34 wherein said connector assembly includes a tubular portion which is integrally formed as one piece with said cover and extends around said portion of said rocker arm assembly when said connector assembly is engaged with said rocker arm assembly.

36. An apparatus as set forth in claim 34 wherein said cover includes an upper wall and first and second end walls which extend downward from said upper wall, said first end wall including first surface means for defining a first recess which opens downward toward said upper portion of said engine, said second end wall including second surface means for defining a second recess which opens downward toward said upper portion of said engine, said camshaft extends through said first and second recesses when said connector assembly is engaged with said rocker arm assembly.

37. An apparatus as set forth in claim 34 wherein said cover includes an inner side surface which is engaged by lubricating liquid during operation of said engine, and a longitudinally extending rib which extends along the inner side surface of said cover and is disposed above said camshaft, said longitudinally extending rib being effective to promote downward dripping of lubricating liquid from the inner side surface of said cover toward said camshaft during operation of said engine.

38. An apparatus as set forth in claim 37 wherein said connector assembly extends downward from said inner side surface of said cover to engage said rocker arm assembly.

39. An apparatus comprising an internal combustion engine having an upper portion, an overhead camshaft connected with and rotatable relative to said upper portion of said engine, a plurality of rocker arms disposed on said upper portion of said engine and movable by said camshaft, a cover extending over said camshaft and said rocker arms, and a plurality of projections extending upward from said upper portion of said engine, said cover including a plurality of retainers having openings in which said projections are received, each of said projections having an outer side surface which is slidably engaged by a retainer to enable said cover to be connected with said upper portion of said engine by manually applying force to said cover to push said retainers downward onto said projections and to enable said cover to be disconnected from said upper portion of said engine by manually applying force to said cover to pull said retainers upward away from said projections.

40. An apparatus as set forth in claim 39 wherein said plurality of retainers includes a plurality of tubular sections which project downward from said cover and telescopically receive said plurality of projections.

41. An apparatus as set forth in claim 39 wherein said plurality of projections includes first and second fasteners each of which has an outer side surface adapted to be engaged by a tool, said plurality of retainers including a first retainer which extends around the outer side surface of said first fastener and a second retainer which extends around the outer side surface of said second fastener when said cover is connected with said engine.

42. An apparatus as set forth in claim 39 wherein said cover includes a plurality of longitudinally extending rib sections which extend downward from said cover, said plurality of longitudinally extending rib sections including a first group of rib sections which extend along said camshaft and promote downward dripping of lubricating liquid from said cover toward said camshaft and a second group of rib sections which promote downward dripping of lubricating liquid from said cover toward said rocker arms, said second group of rib sections including rib sections having longitudinal axes extending transversely to longitudinal axes of rib sections of said first group of rib sections.

43. An apparatus as set forth in claim 39 wherein said cover includes surface means for defining first and second recesses which open downward toward said upper end portion of said engine and through which said camshaft extends.

44. An apparatus as set forth in claim 39 wherein said cover includes an upper wall portion, a first end wall portion which extends downward from said upper wall portion and which has a lower edge portion which at least partially defines an open gap between said first end wall portion and said upper portion of said engine, a second end wall portion extends downward from the upper wall portion and has a lower edge portion which at least partially defines an open gap between said second end wall portion and said upper portion of said engine, an outer wall portion which extends downward from said upper wall portion and extends between said first and second end wall portions and which has a lower edge portion which at least partially defines an open gap between said outer wall portion and said upper portion of said engine.

45. An apparatus as set forth in claim 44 wherein said upper wall portion of said cover is engaged by lubricating liquid during operation of said engine, said cover further including a plurality of longitudinally extending rib sections which extend downward from said upper wall portion, said plurality of longitudinally extending rib sections including a group of rib sections having longitudinal axes which extend transversely to said first and second end wall portions and are disposed above said camshaft to promote a downward dripping of lubricating liquid toward said camshaft.

46. An apparatus as set forth in claim 44 wherein said upper wall portion of said cover is engaged by lubricating liquid during operation of said engine, said cover further including a first longitudinally extending rib section which extends along said upper wall portion of said cover in a direction away from said camshaft to a location over an outer end portion of a first one of said rocker arms and a second longitudinally extending rib section which extends along said upper wall portion of said cover in a direction away from said camshaft to a location over an outer end portion of a second one of said rocker arms, said first and second rib sections being effective to direct a flow of lubricating liquid away from aid camshaft toward the locations over the outer end portions of said first and second ones of said plurality of rocker arms during operation of said engine.

47. An apparatus comprising an internal combustion engine having an upper portion, a plurality of cylinders connected with said upper portion of said engine and disposed in a linear array, a plurality of groups of projections are connected with said upper portion of said engine, each group of projections being disposed adjacent to one of said cylinders, a plurality of inner covers disposed in a linear array, each of said inner covers in said linear array of inner covers being disposed adjacent to one of said cylinders and enclosing one of said groups of projections, each one of said inner covers in said linear array of inner covers including an upper wall which extends over one of said groups of projections, each one of said inner covers in said linear array of inner covers including a plurality of tubular sections which are integrally formed as one piece with said upper wall of said one of said inner covers and extend downward from said upper wall of said one of said inner covers, each of said tubular sections of each one of said inner covers in said linear array of inner covers being disposed in a telescopic relationship with one of said projections to retain said one of said inner covers in a desired position relative to said upper portion of said engine during operation of said engine, and an outer cover which extends over each of said inner covers in said linear array of inner covers, said outer cover having a length which is at least as great as the length of said linear array of inner covers, said outer cover being movable relative to said upper portion of said engine between a closed position extending over said linear array of inner covers and an open position offset from said linear array of inner covers to provide access to said linear array of inner covers.

48. An apparatus as set forth in claim 47 wherein said engine has an overhead camshaft which extends along said upper portion of said engine adjacent to each of said cylinders in said linear array of cylinders, each one of said inner covers including end walls which are integrally formed as one piece with said upper wall of said one inner cover, each of said end walls of said one inner cover having a downwardly opening recess through which said overhead camshaft extends.

49. An apparatus as set forth in claim 47 wherein each one of said inner covers include a pair of end walls and an outer side wall which are integrally formed as one piece with said upper wall of said one inner cover, said end walls and said outer side wall of said one inner cover having lower edge portions which define open gaps between said upper portion of said engine and said end walls and outer side wall of said one inner cover.

50. An apparatus as set forth in claim 47 wherein each of said projections includes a fastener having an outer side surface adapted to be engaged by a tool, each of said tubular sections extends around the outer side surface of a fastener of one of said projections.

* * * * *